US007438670B2

(12) United States Patent
Gray et al.

(10) Patent No.: US 7,438,670 B2
(45) Date of Patent: Oct. 21, 2008

(54) EXERCISE DEVICE FOR SIDE-TO-SIDE STEPPING MOTION

(75) Inventors: Gary Gray, Adrian, MI (US); Daniel Moon, Riverside, IL (US); Robert Starr, St. Charles, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 581 days.

(21) Appl. No.: 10/663,380

(22) Filed: Sep. 16, 2003

(65) Prior Publication Data

US 2004/0162193 A1 Aug. 19, 2004

Related U.S. Application Data

(60) Continuation-in-part of application No. 09/596,383, filed on Jun. 16, 2000, now Pat. No. 6,620,080, which is a continuation-in-part of application No. 09/174,306, filed on Oct. 16, 1998, now Pat. No. 6,077,202, application No. 10/663,380, filed on Sep. 16, 2003, which is a continuation-in-part of application No. 10/608,845, filed on Jun. 27, 2003, now Pat. No. 7,014,596, which is a continuation of application No. 09/577,914, filed on May 24, 2000, now Pat. No. 6,679,813, which is a division of application No. 09/174,306, filed on Oct. 16, 1998, now Pat. No. 6,077,202.

(60) Provisional application No. 60/062,577, filed on Oct. 17, 1997.

(51) Int. Cl.
*A63B 22/04* (2006.01)

(52) U.S. Cl. ..... 482/52; 382/53

(58) Field of Classification Search ..... 482/70–71, 482/51–53, 79–80
See application file for complete search history.

(56) References Cited

U.S. PATENT DOCUMENTS

| | | | | |
|---|---|---|---|---|
| 1,015,071 | A | | 1/1912 | Reach |
| 2,068,578 | A | | 1/1937 | Stronach |
| 2,544,106 | A | | 3/1951 | Ray |
| 2,829,891 | A | | 4/1958 | Ludwig |
| 2,906,532 | A | | 9/1959 | Echols |
| 3,374,782 | A | * | 3/1968 | Izzo ..... 601/27 |
| 3,475,020 | A | | 10/1969 | Schauerte |
| 3,475,021 | A | | 10/1969 | Ruegsegger |
| 3,485,495 | A | | 12/1969 | Gibbs |
| 3,511,500 | A | | 5/1970 | Dunn |
| 3,713,653 | A | | 1/1973 | Romans |
| 3,756,595 | A | | 9/1973 | Hague |
| 3,792,860 | A | | 2/1974 | Selnes |
| 3,814,420 | A | | 6/1974 | Encke |
| 3,833,215 | A | | 9/1974 | Isdith |
| 4,120,294 | A | * | 10/1978 | Wolfe ..... 600/519 |
| 4,340,214 | A | | 7/1982 | Schutzer |
| 4,396,189 | A | | 8/1983 | Jenkins |
| 4,509,742 | A | | 4/1985 | Cones |
| 4,563,001 | A | | 1/1986 | Terauds |
| 4,577,861 | A | | 3/1986 | Bangerter et al. |
| 4,601,468 | A | * | 7/1986 | Bond et al. ..... 482/7 |
| 4,609,190 | A | | 9/1986 | Brentham |

(Continued)

*Primary Examiner*—Fenn C Mathew
(74) *Attorney, Agent, or Firm*—Lewis, Rice & Fingersh, L.C.

(57) ABSTRACT

Exercise machines and methods of exercising which utilize a side-to-side stepping motion to exercise the lower extremities.

29 Claims, 16 Drawing Sheets

U.S. PATENT DOCUMENTS 4,708,338 A 11/1987 Potts
4,739,984 A 4/1988 Dranselka
4,781,372 A * 11/1988 McCormack ..... 482/70
4,830,362 A 5/1989 Bull
4,900,012 A 2/1990 Fu
4,915,373 A * 4/1990 Walker ..... 482/51
4,934,688 A 6/1990 Lo
4,938,474 A 7/1990 Sweeney et al.
4,989,858 A 2/1991 Young et al.
5,100,129 A 3/1992 Porter et al.
5,178,596 A 1/1993 McIntire
5,199,931 A * 4/1993 Easley et al. ..... 482/52
5,209,711 A 5/1993 Scrima
5,221,242 A 6/1993 Weber et al.
5,222,928 A * 6/1993 Yacullo ..... 482/71
5,242,340 A * 9/1993 Jerome ..... 482/52
5,256,117 A 10/1993 Potts et al.
5,284,460 A * 2/1994 Miller et al. ..... 482/51
5,298,002 A 3/1994 Lin
5,304,106 A * 4/1994 Gresko ..... 482/53
5,316,528 A 5/1994 Ziparo
5,316,530 A 5/1994 Romer
5,328,427 A 7/1994 Sleamaker
5,336,143 A 8/1994 Wu
5,352,185 A 10/1994 Blauth et al.
5,356,362 A 10/1994 Becker et al.
5,372,564 A 12/1994 Spirito
5,391,130 A * 2/1995 Green et al. ..... 482/71
RE34,959 E 5/1995 Potts
5,441,472 A 8/1995 Johnston
5,487,711 A 1/1996 Little
5,499,956 A 3/1996 Habing et al.
5,499,958 A 3/1996 Hess
5,509,880 A 4/1996 Becker et al.
5,509,894 A 4/1996 Mason et al.
5,518,470 A 5/1996 Piaget et al.
5,520,598 A 5/1996 Little
5,527,247 A 6/1996 Archambault
5,540,637 A 7/1996 Rodgers, Jr.
5,665,033 A * 9/1997 Palmer ..... 482/71
5,692,995 A * 12/1997 Alvarez et al. ..... 482/71
5,749,807 A * 5/1998 Webb ..... 482/52
5,807,210 A * 9/1998 Devlin ..... 482/52
5,961,423 A 10/1999 Sellers
6,641,506 B1 * 11/2003 Yang ..... 482/52
6,786,850 B2 * 9/2004 Nizamuddin ..... 482/51

* cited by examiner

EXERCISE DEVICE FOR SIDE-TO-SIDE STEPPING MOTION

CROSS REFERENCE TO RELATED APPLICATIONS

This application is: a Continuation-In-Part of U.S. patent application Ser. No. 09/596,383 filed Jun. 16, 2000 now U.S. Pat. No. 6,620,080 which in turn is a Continuation-in-Part of U.S. patent application Ser. No. 09/174,306 filed Oct. 16, 1998 now U.S. Pat. No. 6,077,202 which in turn claims priority to U.S. Provisional Patent Application 60/062,577 filed Oct. 17, 1997; and is a Continuation-In-Part of U.S. patent application Ser. No. 10/608,845 filed Jun. 27, 2003 now U.S. Pat. No. 7,014,596 and currently pending which is a Continuation of U.S. patent application Ser. No. 09/577,914 filed May 24, 2000 U.S. Pat. No. 6,679,813 and currently pending which is a Divisional of U.S. patent application Ser. No. 09/174,306 filed Oct. 16, 1998 now U.S. Pat. No. 6,077,202 which in turn claims priority to U.S. Provisional Patent Application 60/062,577 filed Oct. 17, 1997. The entire disclosure of all these documents is herein incorporated by reference.

BACKGROUND

1. Field of the Invention

This disclosure relates to the field of exercise machines. In particular, to exercise machines for exercising the lower body using a side-to-side stepping motion.

2. Description of the Related Art

The benefits of regular aerobic exercise on individuals of any age is well documented in fitness science. Aerobic exercise can dramatically improve cardiac stamina and function, as well as leading to weight loss, increased metabolism and other benefits. At the same time, aerobic exercise has often been linked to damaging effects, particularly to joints or similar structures where the impact from many aerobic exercise activities causes injury. Therefore, those involved in the exercise industry are continuously seeking ways to provide users with exercises that have all the benefits of aerobic exercise, without the damaging side effects.

Many exercise machines today suffer from being unable to provide the types of exercise motion that a user demands. They can generally only provide motions similar to those used when walking or running. Further, they can require significant space in which to operate decreasing their accessibility.

SUMMARY

Because of these and other problems in the art, described herein, among other things, are exercise machines and methods of exercising which utilize a side-to-side stepping or rocking motion to provide for exercise. This type of motion is generally of lower impact than motions such as running or playing sports and provides for a type of exercise different from other machines as the motion does not appear similar to walking or running, but is a side stepping motion more akin to skating. Further, the machine has a compact footprint and requires little space and is simple to understand and use allowing for increased user accessibility.

In an embodiment there is described herein, an exercise machine comprising: a frame; a first footpad connected to said frame so as to rotate along a first path in a first direction about a first drive axis; a second footpad connected to said frame so as to rotate along a second path in a second direction about a second drive axis; and a resistance mechanism attached to said frame, said resistance mechanism effecting said rotation of said first footpad along said first path and said rotation of said second footpad along said second path; wherein said second path is non-parallel to said first path; and wherein said first footpad and said second footpad each move independently of the motion of the other.

In an embodiment, the resistance mechanism resists said rotation of said first footpad along said first path and said rotation of said second footpad along said second path, or will brake a drive shaft being alternatively driven by said first footpad rotating along said first path and then said second footpad rotating along said second path when said drive shaft reaches a predetermined velocity.

In an embodiment, the first drive axis and said second drive axis are arranged substantially horizontally, may be parallel to each other or may be co-linear. The first drive axis also may be angled relative to said second drive axis. The first path may be a mirror image of said second path which may exist such that when viewed from a fixed location, the first path comprises rotation in a clockwise direction about said first drive axis and said second path when viewed from said fixed location, comprises rotation in a counterclockwise direction about said second drive axis. The paths may, in turn, include motion which is vertically downward.

In an embodiment, the frame may include a base and a vertical support which may includes handgrips, and/or may have a control panel attached thereto.

In an embodiment, the machine may include a mechanism for collecting physiological data of a user of the machine which may be used to alter the operation of said machine.

In an embodiment, the first path is coplanar with said second path. The first or second footpad may also retain a constant angle to the horizontal while rotating along the first path In an embodiment, each of said first foot pad and said second foot pad are rotationally mounted to an arm and each of said arms rotates about the appropriate drive axis. This arm may extends as said first foot pad traverses said first path. The first footpad and said second footpad may be rotationally mounted to a link and each of said links rotates about a link axis and the link and said arm may work together to maintain the angle of said footpads relative to the horizontal.

In an embodiment, the resistance mechanism utilizes electromagnetic resistance, such as an eddy current brake (ECB) and may include a brake on a drive shaft.

In an embodiment, the user adjusts the speed of their motion to alter the difficulty of the exercise.

In another embodiment, there is herein described, An exercise machine comprising: a frame; means attached to said frame for having a first foot of a user move along a first path; means attached to said frame for having a second foot of a user move along a second path, wherein said second path is non-parallel to said first path and said second path and said first path are coplanar; and means attached to said frame for effecting said movement of said first foot along said first path and for effecting said movement of said second foot along said second path; wherein said movement of said first foot occurs independently of said movement of said second foot.

In yet another embodiment, there is herein described, A method of exercising comprising: providing an exercise machine including: a frame; and at least two footpads moveably mounted on said frame such that each of said footpads can move independently of the other; placing a first human foot on a first of said footpads; placing a second human foot on a second of said footpads; visualizing a first plane passing through the toe, heel, and calf of said first human foot and a second plane passing through the toe, heel, and calf of said second human foot; moving said first human foot and said second human foot interchangeably in a manner so as that said planes are both translated relatively simultaneously along a path non-parallel to said planes.

In yet another embodiment the translation is along an arcuate path or a linear path. The path may have a component perpendicular to at least one of said planes, the planes may be parallel and the translation of the first plane may be coplanar with the translation of said second plane.

DESCRIPTION OF PREFERRED EMBODIMENT(S)

Although the machines, devices, and methods described below are discussed primarily in terms of their use with particular layouts of exercise machines utilizing various resistance mechanisms, motion translation parts, and footpad assemblies, one of ordinary skill in the art would understand that the principles, methods, and machines discussed herein could be adapted, without undue experimentation, to be useable on exercise machines utilizing other components.

For the purposes of this disclosure, the terms horizontal and vertical will be used when referring to the motion of the user's feet and in conjunction with components of the machine. One of ordinary skill in the art will understand that depending on the arrangement of the parts and how the machine is used, the horizontal and vertical dimensions may be altered from strict horizontal and vertical relative to the surface of the earth. For the purposes of this disclosure, the horizontal dimension refers to generally a dimension planar with the surface of the earth at the instant of occurrence and the vertical dimension is the dimension perpendicular thereto. Generally, this motion will also relate to the motion of a user's feet when using the machine. The vertical plane of motion of a person's feet will generally be the plane in which a standing human being lifts their feet upwards from the surface of the earth while the horizontal plane would be moving their feet parallel to the surface of the earth.

Figure 17A:
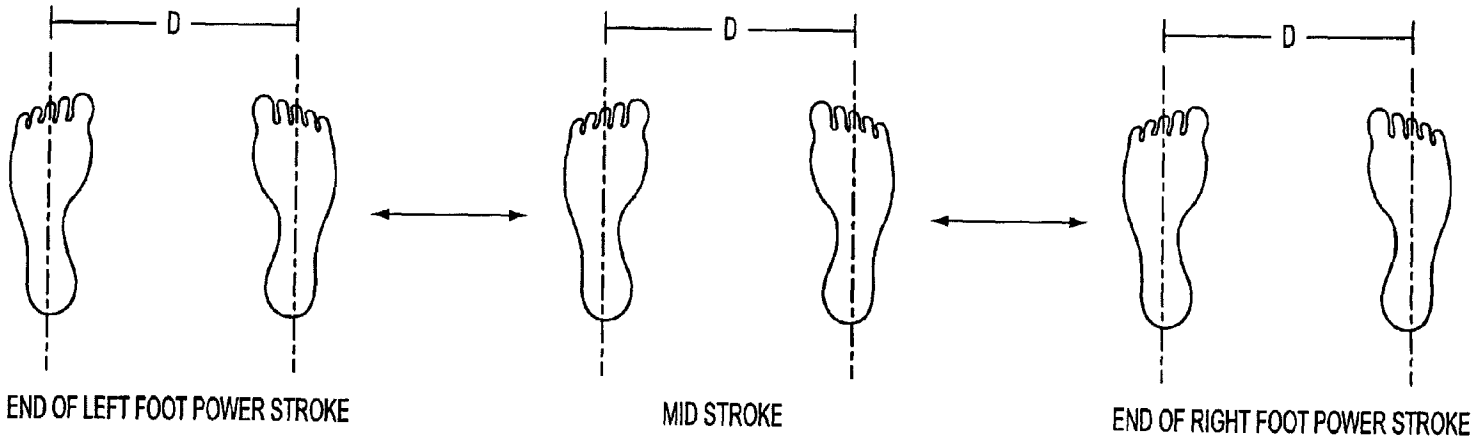
In FIG. 17A the planes of the feet are simply translated together, In FIG. 17B the feet may slide relative to each other as they are translated. The horizontal movement of the feet in FIG. 17 is greatly exaggerated to better depict the concept.
Figure 17B:
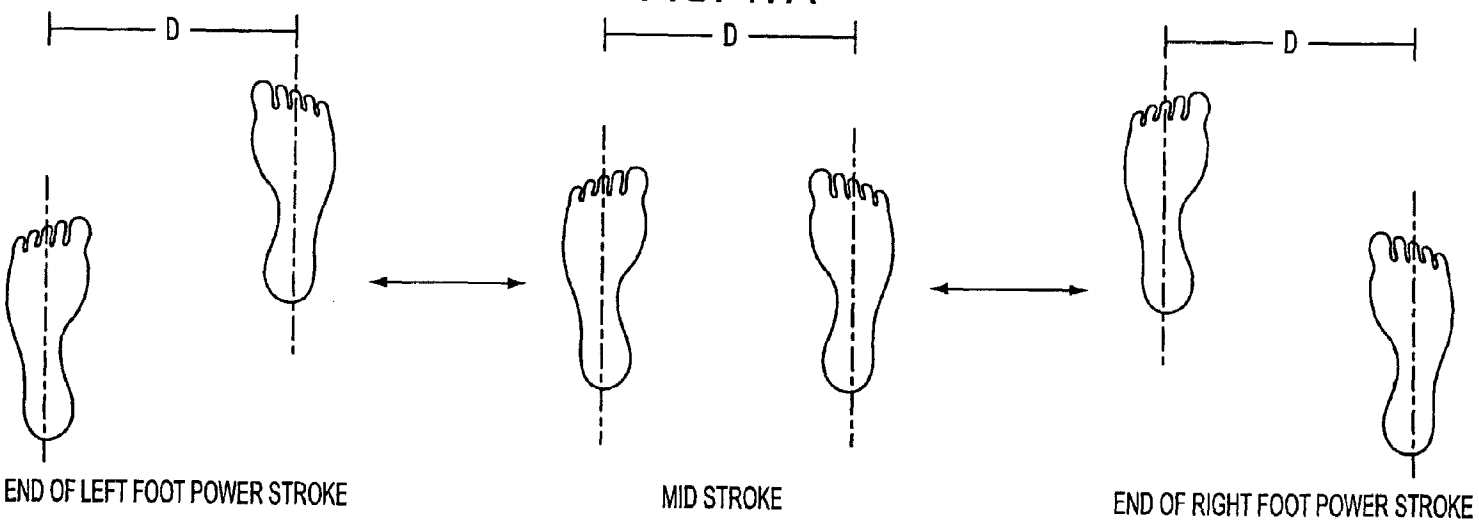
FIG. 17 provides for a series of conceptual drawings showing how the feet can remain relatively the same distance apart to each other as they shift from side-to-side.

In the described embodiments, the user will generally utilize a side-to-side stepping motion for exercising the major muscle groups of the lower extremities. This motion will generally result from the feet being placed parallel to each other facing forward and then being pushed apart with the left foot being moved to the left of the user and downward and the right foot being moved to the right of the user and downward in a weight-shifting or stepping type motion. One foot is generally being raised while the other is moving downwards. To think of this another way, if the feet are represented by planes through the heel and toe and generally extending up the calf, the planes would maintain a fairly constant relationship with each other moving in a direction non-parallel to them both. This motion may be more of a rocking type motion or a rotational type motion as shown in FIG. 17 where the planes translate across the page (essentially the horizontal plane) as shown by the double-headed arrows as the exercise is performed. The planes will not simply slide across each other (what would be into and out of the page) or up and down although they may slide while translating (as shown in FIG. 17B by the slide up and down on the figure and the side to side translation). This motion is preferably performed by each foot independently.

In another embodiment, both feet may slide simultaneously outward or inward e.g. each foot may slide outward or inward at the same time (similar to the motion used when performing a "jumping jack" exercise). In this type of motion, the planes above move apart and then together. The exact ability of the machine to provide for types of motion will depend on the embodiment of the machine used, and the type of exercise desired by the user.

The FIGS. provide multiple views of four different embodiments of an exercise machine (5) for providing the side-to-side stepping motion where the user first steps to the right then to the left and so on. The operation of each of the exercise machines (5) is generally similar and the different embodiments all utilize the same principles in operation. Each exercise machine (5), however, generally utilizes different components in its specific operation to provide for the exercise. Each exercise machine (5) generally comprises a base (7) which is used to support the exercise machine (5) on the floor or other surface where it is being used, a vertical support (901) which provides for handgrips (903) for the user and the mounting of a control panel (19), a resistance mechanism (905) which provides resistance for the exercise, and the footpad assemblies (907) and (909) which provide for the interaction with the user to perform the side-to-side exercise motion. Within these broad subcomponents different embodiments utilize different constructions.

The base (7) is designed to be the support of the exercise machine (5) on the surface upon which it rests. The base (7) may be of any shape put will generally have a sufficient footprint to prevent the device from overly wobbling when in use. There are two different designs of bases (7) shown in the FIGS. In the embodiments of FIGS. 1-12, the base (7) is substantially U-shaped having two side members (9) and a front member (11). In the embodiment of FIGS. 13-16, the base (7) is simply three generally parallel strips (71), (73), and (75) arranged to extend generally from one side to the other. The bases (7) shown are merely exemplary and the base (7) may be of any shape or size and the design is purely one of design choice. For purposes of this disclosure, the base (7) simply comprises the portion of the exercise machine (5) which interacts directly with the surface upon which the exercise machine (5) is resting.

Attached to the base (7) there will generally be a vertical support (901). In some embodiments, however (such as those designed to be particularly compact), the vertical support (901) may be eliminated. Together, the base (7) and vertical support (901) will comprise the frame of the exercise machine (5) which generally gives the exercise machine (5) its shape and provides for a support to hold the remaining components of the exercise machine (5). The vertical support (901) extends upwardly from the base (5), and may be of any shape or style. The vertical support (901) may be functionally designed to support other components or desirable parts of the exercise machine (5), may be aesthetically designed to make the exercise machine (5) pleasing to the appearance, or may be a combination of the two. Generally, in providing functionality, the vertical support (901) will serve two purposes. The user of the exercise machine (5) is generally intended to be standing (or in another embodiment crouching) when using the exercise machine (5). Therefore, towards an upper end of the vertical support (901), there may be provided one or more handgrips (903) to allow the user to have additional contact points with the exercise machine (5). Handgrips (903) provide a recognized contact point that is conveniently placed to allow a user of the exercise machine (5) to grasp and steady themselves when they are using the exercise machine (5).

The handgrips (903) will generally be provided at a comfortable location or may be positioned to promote a particular posture on the exercise machine (5) to help the user keep their balance. In an embodiment, the handgrips (903) can be used to help the user to maintain a straight posture, instead of "leaning into" the exercise. This can help improve the results of the workout and can also help to prevent injury. Alternatively, the handgrips (903) may encourage the user to crouch.

The handgrips (903) may also provide additional functionality to the user. The handgrips (903) may include sensing devices which can detect a user's heart rate through their gripping of the handgrip (903) and provide feedback of the user's aerobic performance. Alternatively or additionally, handgrips (903) may be used by the user to steady their upper body during the performance of the exercise. This can allow the user to carry on an additional activity, such as reading a book or watching TV, while exercising. The handgrips (903) may be padded or covered to provide for increased grip and a more comfortable grasp, or may simply be parts of the frame or attached to the frame. The handgrips (903) may also move in an embodiment to be adjustable for comfort. Alternatively, the handgrips (903) can move to allow the hands or arms to move in conjunction with, or out of sink with, the with the feet to provide a more total body exercise.

The vertical support (901) may also have a control panel (19) mounted thereon. A control panel (19) is often a computer or other electronic control and feedback system (although an analog or mechanical control or feedback can be used) for controlling the resistance and speed of the exercise machine (5), or for the user to obtain feedback about the effectiveness of their exercise. In other embodiments, a control panel (19) is not necessary as the exercise machine (5) either has only one setting, or manual control is performed directly on the exercise machine (5).

An advantage of having a control panel (19) mounted on the vertical support (901) is that the user can more easily interact with the exercise machine (5) during the exercise. The control panel (19) may be placed at a location where it is easily viewed by the user of the exercise machine (5) during the exercise. This allows for continuous monitoring of exercise activity. Further, as controls for the exercise machine (5) (for instance resistance level or foot acceleration) may be controlled by the exercise machine (5) during the exercise activity, the user may be able to alter specifications of the exercise as they are performing it, allowing for a better workout.

In an embodiment, the user may control the exercise machine (5) through direct feedback based on their exercise. For instance, a user may be connected to the exercise machine (5) in a manner so that electrical signals representative of the user's heart rate, breathing, or other physiological conditions influence the operation of the exercise machine (5). In this way, the user obtains a customized workout.

Both the base (7) and vertical support (901) comprise the frame of the exercise device (5). While some alternatives for these are shown in the FIGS., frames for supporting the moving parts of exercise machines (5) are generally well known to those of ordinary skill in the art and frames may be built to meet just about any needs. The frames depicted in the embodiments show four variations on frames which can be used. The frames of the first and second embodiment (FIGS. 1-6) are generally constructed to be designed to provide both handgrips (903) and control panels (19) while also supporting components of the resistance mechanisms (905) in a manner that allows them to provide resistance to the footpad assemblies (907) and (909). In the third embodiment, a much simpler vertical support (901) is used as it provides only handgrips (903) and a control panel (19). In the fourth embodiment, the vertical support (901) again supplies the handgrips (903) and the control panel (19) but does so in an aesthetically pleasing manner to improve the overall look of the exercise machine (5).

The third major component of the exercise machine (5) is the resistance mechanism (905). A resistance mechanism (905) serves to provide some type of resistance to the user of the exercise machine (5) when exercising. For safety, the resistance mechanism (905) may be covered by a protective cover such as cover (805). Working against this resistance is what provides the exercise to the user. Generally, a resistance mechanism (905) will have some type of access device which is turned (rotated), slid, or otherwise moved. In the depicted embodiment of FIGS. 1-4 and 7-16 this is drive shaft (91). The user's exercise motion is translated to work on this access device. Resistance mechanisms (905) can utilize numerous forms of resistance. These include gravitational forces (such as the lifting of weights under the influence of gravity), mechanical forces (such as the return forces of springs, bending or deforming of materials, or friction between two objects), fluid forces (such as the resistance created by moving an object through a viscous fluid, compressing fluid(s), or by moving against a pressure differential), and electromechanical or electromagnetic forces (such as generating electricity using an alternator, moving against an electrical load, or otherwise moving an electromagnetic field within another electromagnetic field).

Exercise machines (5) may use any type of resistance mechanism (905) known now or later discovered to generate resistance to the exercise motion. In the depicted embodiments, some of the resistances used include mechanical resistance caused by moving a flywheel within a tension belt (FIGS. 1-4), hydraulic or pneumatic resistance caused by extending or contracting a pressure cylinder (FIGS. 5-6), or eletromechanical resistances such as an alternator (FIGS. 7-12) or an eddy current brake (ECB) (FIGS. 13-16).

Where an electromechanical resistance is used, the resistance mechanism (905) may be operatively connected to a battery (74). As the exercise device (5) is in use, the resistance mechanism (905) can provide electrical current to the control panel (19) to provide the electricity for operating the control panel (19) and excess current may be directed to the battery (74). When the user first starts the exercise, energy may be supplied from the battery (74) to the control panel (19) to allow the control panel (19) to operate until such time that the resistance mechanism (905) is producing sufficient electrical current to power the control panel (19).

The resistance mechanism (905) may also be operatively connected to a device (78) such as a heat sink which absorbs or dissipates excess energy as heat when the battery (74) is fully charged or when the energy is no longer needed, or the electricity may be transferred to other devices to enhance operation of the exercise machine (5). In an example, the electricity generated could power a radio for the user to listen to, or could be used to power a lamp for illuminating reading material.

Resistance mechanisms (905) will generally provide that motion imparted on a drive shaft (91) or similar access device on the resistance mechanism (905) will be resisted by the resistance mechanism (905). This drive shaft (91) or similar access device will then be linked to the footpad assemblies (907) and (909) so as to provide resistance to the motion of the user. This resistance may be either one-way or two-way. A one-way resistance will generally produce a force only when the user moves their foot in one of the two allowed directions. Therefore, a one-way resistance will have a power stroke from a first configuration to a second configuration, followed by a resting stroke where the footpad assembly (907) or (909) returns from the second configuration back to the first configuration without significant work by the user. For instance, the user must push downward and sideways against the resistance while the return motion will generally be non-resisted and may actually have a helping force to help return the footpad assembly (907) or (909) to the position for the next resisted movement. This will generally be the preferred motion as it is more natural motion for the movement of the legs.

In an alternative embodiment, the resistance may be two-way, whereby a user must both push their foot down against resistance, and forcibly pull it back up against resistance. In this situation, the user would generally have to have their feet firmly attached to the footpad assemblies (907) and (909), otherwise, they would simply lift their foot from the footpad (127) in the return stroke. While this type of motion is not as natural, it can result in a much more efficient workout and can exercise muscle groups which are not necessarily used in the one-way motion.

A resistance mechanism (905) need not have the same type of resistance as the resulting exercise. A one-way resistance mechanism (905) can be made two-way and vice-versa using other structures. For instance, in most of the depicted embodiments, a resistance mechanism (905) which would generally have a two-way resistance, may be made to be a one-way resistance through the inclusion of slip clutches (103) and (107) or similar components which allow motion in one direction to disengage from the resistance mechanism (905), while the other direction engages the resistance mechanism (905).

Generally, the resistance provided by the resistance mechanism (905) will correspond to the desired difficulty of the exercise. In an embodiment, this resistance may simply provide for an amount of work a user must provide to move the footpad assembly (907) or (909) downward (or upward). That is the resistance is simply how hard a user must push to have the footpad descend. In another embodiment, the resistance of the mechanism can be used to alter the speed which the user must operate the footpad assemblies (907) and (909).

In this latter embodiment, the user will begin to alternatively step on the footpads. This will begin driving the drive shaft (91) of the resistance mechanism. Once the speed of rotation of the drive shaft (91) reaches a particular value, generally selected by the control panel (19) or by other structure in the machine, the rotation of the drive shaft (91) will be braked. The manner of braking will relate to the type of resistance mechanism (905) used. For instance, the electrical load may be altered or increasing friction may be applied to a flywheel. The user, therefore, must move their feet fast enough to keep the drive shaft (91) rotating at the speed where the exercise machine (5) will implement the braking. If they move too slow, the footpads (127) will hit the ground. If they move fast enough, the resistance to their motion will allow the footpads to "float" comfortably above the ground. The amount of work produced by the user increases when the user has to move their feet faster. Effectively the user's feet accelerate faster as they need to move their feet from a stop to a predetermined velocity in a shorter instant of time, or move to a higher velocity in the same time, to maintain sufficient torque on the drive shaft (91) to reach the speed at which the drive shaft (91) is braked.

Providing resistance for exercise is well understood in the art, and it would be understood that the types of resistance mechanisms (905) included herein are merely exemplary of what can be used. Essentially, any mechanism which can resist the motion of the footpad assemblies (907) and (909) can be used as a resistance mechanism (905) whether that resistance is applied directly to make the footpad assemblies (907) and (909) harder to move, or is used to provide a comfortable resistance which the user must then alter their speed to maintain. Further, any necessary gearing or structure can be used to provide for an interrelationship between the resistance mechanism (905) and the resulting resistance of the exercise.

In order to provide the side-to-side motion, the exercise machine (5) also includes a pair of footpad assemblies (907) and (909) which provide for the side-to-side motion of the exercise and allow the user to interact with the exercise machine (5). The footpad assemblies (907) and (909) provide for the location of the user's foot during the exercise, and provide for the movement of the foot while the user performs the exercise by remaining in contact with the feet. The footpad assemblies (907) and (909) provide the side-to-side motion by essentially having a particular path of movement, when the user uses the exercise machine (5), they are essentially guided by the exercise machine (5) to move their foot in a prescribed path to perform the desired exercise motion. Further, motion of the footpad assembly (907) or (909) on the path is effected by the resistance mechanism (905) as discussed above leading to exercise being performed.

In operation, each footpad assembly (907) or (909) is preferably designed to move independently of the other and each is designed to provide for side-to-side motion. When the exercise is performed, the user will begin with the footpads (127) in the uppermost position and with them close together. The user will then push down on the footpad (127). Generally, the user will only push down on one footpad (127) at a time (using one footpad assembly (907) or (909)), but in an alternative embodiment or operation, they may push on both simultaneously. The one footpad (127) motion is more akin to the motion of skating, sideways rocking, or sideways stepping as the user is essentially shifting their weight to the leg going down from the leg coming up, and are pushing downward and sideways with that foot.

As opposed to prior exercise machines, the motion of each foot, and the relative motion of the two feet relative to each other is quite different from walking or running motion in appearance. The feet start out generally parallel to each other, as the user would be with their feet pointed forward. The feet are generally set at a slight distance apart so that this position is a comfortable resting position. One foot is then pushed by the user to the side and downward. That is, the foot is shifted horizontally away from the other foot in a direction at an angle to a line drawn from the toe to the heel, of either foot. It is preferred, but by no means required, that the motion be generally perpendicular to the line in the horizontal dimension but it may be angled. The foot is moving straight and sideways, sideways and back, or sideways and forward in the different embodiments.

To put this another way, if a plane is drawn through the calf, heel, and toe of each foot of the user, during the exercise the two planes will generally stay at a relative consistent distance between them while both are translated in space. This translation may be linear (in the generally perpendicular case) or may include some rotation. Conceptual examples of these translations are shown in FIG. 17 by looking down and at the feet of the user. FIG. 17A shows the linear translation while 17B allows for some rotation. In both cases the feet stay approximately the distance D apart while the feet move side to side. This is as opposed to the motion of a "stair-climber" machine where the planes simply slide relative to each other. To put this another way, the motion of this machine has at least a component of the motion in the frontal plane (and the motion may be purely in the frontal plane) where a stair-climber type machine has motion purely in the sagittal plane.

To put this still another way, the path of motion of a footpad is preferably non-parallel but coplanar to the path of motion of the other footpad. In the depicted embodiments, they are rotationally reversed so that one footpad (127) (generally for the right foot) rotates clockwise on the power stroke, while the other footpad (127) (generally for the left foot) rotates counterclockwise on the power stroke. As the foot is shifted horizontally, it is also preferably pushed downward. The downward portion of the stroke allows for the user to generate additional force to move the foot from the knee, thigh, or hips. Once the foot has reached a lowest point, the user will switch their weight to the other foot and begin depressing that foot in the same manner, but in the generally opposite horizontal direction. As they push with this foot, the other foot is in a relaxation state and the foot is allowed to drift back to the uppermost position in preparation for another power stroke.

To perform this type of exercise, the footpad assembly (907) or (909) moves outward and downward relative to the position of the other footpad assembly (907) or (909). In the depicted embodiments, the path is generally arcuate and is generated by independent rotation of a footpad (127) about an axis of rotation (219). This rotation is performed using a two-bar rotational method to allow the footpad (127) to remain in a relatively fixed positioning as it is pushed downward and not to twist which could injure the ankle. While this is a preferred construction and the preferred mechanism, this arrangement is by no means required and in other embodiments the footpad assemblies (907) and (909) could descend linearly or according to any path instead of or in addition to in an arc.

In constructing the footpad assembly (907) and (909) each footpad assembly (907) and (909) is generally constructed in the same manner. This section will describe the construction of just one of those assemblies from an embodiment of the invention utilizing a rotational path. In particular footpad assembly (907) will be discussed as the other footpad assembly (909) is the same design simply reversed in its positioning on the frame so as to move in the opposite horizontal direction. A support flange (115) is generally secured to the front of the base (7). A main drive cylinder (119) is then extended between the support flange (115) and a brace (21) (which is may or may not be part of the vertical support (901)). The main drive cylinder (119) is mounted in a manner whereby it is free to rotate around a drive axis (219) which will generally be arranged to be relatively horizontal and to extend in the direction the user faces when using the machine. An arm (123) is secured to the main drive cylinder (119) toward the end of the main drive cylinder (119) that is adjacent the support flange (115). A foot pad (127) having a base plate (129) attached thereto is pivotally secured to the end of each arm (123) that is spaced apart from the main drive cylinder (119). The base plate (129) is positioned beneath each footpad (127) and the base plate (129) is secured to the arms (123) in a manner to allow the footpad (127) to be pivotally mounted on the arms (123). Generally, the base plate (129) will be comprised of a metal or similar structural material, while the footpad (127) may be constructed of a rubber or other high friction material (and/or may include a tread or other traction enhancing shape) to increase the traction of the user. In alternative embodiments, the footpad (127) may include straps, pockets, or other mechanisms for holding the user's foot to the footpad (127) or may simply be a pad (as shown) for the user to rest their foot on.

A link member (133) is positioned to extend from the base plate (129) to the base (7). The link member (133) is preferably pivotally secured to the base plate (129) at a point separate from the point of securing the arm (123). The other end of the link member (133) is rotationally attached to the base (7). This may be through a simple rotation point (as shown in the embodiment of FIGS. 1-4) or may be through a link cylinder (191) (as shown in FIGS. 13-16). Regardless of construction, this axis of rotation is the link axis (291). The link member (133) may be positioned so that it is not quite parallel to the arm (123), or may be slightly different sized to the arm (123) to provide for different rotation. The construction of the arm (123) and link member (133) along with each of these two components being allowed to rotate about both the axes (219) and (291) at the base (7) and the axes at the base plate (129) allows the link members (133) and arm members (123) to cooperate to maintain the footpad (127) at a fixed angle (which is preferably about 0° to about 15°) with respect to the horizontal (or to the base (7)) as the footpad (127) is allowed to rotate around the main drive axis (219). To put this another way, the system is disposed to maintain the angular relationship of the foot pads (127) to a fixed point as the arm (123) rotates through its positions. The angular relationship may be adjustable by the user such as through an adjustment screw (not shown).

In an embodiment, there may be positioned on the base (7) a pair of stops (137). The stops (137) may extend upwardly from the base (7) and have a cushion region (139) on the end that to engage the footpad (127) to stop further downward rotation of the footpad (127), preferably without a jarring shock. In an alternative embodiment, the system may be designed so that the footpad (127) is "floating" during the exercise where the user does not allow the footpad (127) to reach the base (7) due to the interaction with the resistance mechanism (905) as discussed above.

In an alternative embodiment, the motion may also include a sliding motion for the footpad (127). In this case, the arm (123) and link member (133) may actually comprise extensible designs whereby they extend (or contract) as they rotate through the rotation. In this case, the user could get a path of movement with a more parabolic, hyperbolic, or elliptical shape as they push on the footpad (127). This can provide for a wider or narrower motion and can make the exercise more comfortable. In a more pronounced variation, the motion can resemble more of a speed skating motion with the feet pushed out to a great distance horizontally with each stroke.

As should be apparent from the FIGS., each footpad (127) can preferably move through its arc independently of the other. In a preferred embodiment, this is accomplished by having the footpads (127) attached to different drive axes (219). It is generally preferred that these axes be parallel, but in an alternative embodiment, they may be arranged at an angle to each other to provide a slightly different exercise. In a still further embodiment, the drive axes (219) may be moveable relative to each other. Further, while in the depicted embodiment maintaining a relatively constant alignment of the footpads (127) is desirable, in an alternative embodiment, the footpads could rotate, twist, turn, or move in any additional arcs.

In order to allow the resistance mechanism (905) to provide resistance to the rotation of the footpad (127), the structure of the footpad assemblies (907) and (909) generally needs to be attached to resistance mechanism (905) in a manner whereby the motion of the footpad (127) is effected by the resistance mechanism (905) in the desired manner. As was discussed above, many resistance mechanisms (905) are designed to effect rotational movement, so in an embodiment the main drive cylinder (119) may simply rotate and interface directly with the resistance mechanism (905).

In the depicted embodiments, so as to provide for more power to the user and to allow for better control of the exercise, a lever (145) is secured to each main drive cylinder (119) towards the end of the cylinder spaced from the support flange (115). The lever (145) is disposed to extend generally upwardly from the main drive cylinder (119) and is preferably disposed at an angle that is substantially the same as the angle at which the arm (123) is positioned on the main drive cylinder (119), but this is by no means required. The levers (145) provide for lever action with regards to the movement of the feet and to transfer force imparted on the footpads (127) to the resistance mechanism (905). In alternative embodiments, the lever (145) could be eliminated and the motion of the footpads (127) could be transferred directly to the resistance mechanism (905). The use of levers (145), however, provides for a better feel of the exercise machine (5) as well as better force transfer.

In an embodiment, the force of the lever is transferred from the lever to the resistance mechanism (905) by some type of transfer mechanism (911). In the depicted embodiments of FIGS. 1-4, and 7-17, the resistance is rotational, therefore a chain or belt (149) is connected to the end of each lever (145) that is spaced apart from the main drive cylinders (119). The belt (149) that is connected to the lever (145) in the first footpad assembly (907) generally extends around the first one-way clutch (103) and the belt (149) from the other lever arm (145) in the second footpad assembly (909) extends around the second one-way clutch (107). The ends of the belt (149) that are spaced apart from the levers (145) are generally connected to a spring member (155). The spring member (155) extends from the belt (149) and maybe connected around idler rolls (157) at the end of the spring members (155) that is opposite to the end that is connected to the belt (149) to a hook (159) that is mounted on the frame. The belts (149) are positioned on the first one-way clutch (103) and second one-way clutch (107) so that the clutches are engaged and cause the drive shaft (91) to rotate when the foot pads (127) are moved in a direction toward the base (7) of the exercise device (5) (vertically downward and horizontally away from the center). When the foot pads (127) are moving in a direction away from the base (7) (vertically upward and horizontally toward the center), the first one-way clutch (103) and second one-way clutch (107) are not engaged and they can rotate freely and without causing the drive shaft (91) to rotate. Therefore the footpads (127) will have power to drive the resistance mechanism (905) when a footpad (127) is pressed down and away, but the footpad (127) has less resistance to be returned to the starting point and the returning force of the spring member (155) on the belt (149) helps to return the footpad (127) to the starting position.

In operation, a user desiring to use the exercise device (5) will position his feet on the footpads (127) (one foot on each pad) and place his hands on the handgrips (903) facing the control panel (19). The user will generally stand in a relatively upright or vertical position on the exercise device (5) although the user may assume a crouch position in an alternative embodiment. To initiate the exercise motion, the user directs a larger portion of his body weight onto one the left footpad (127) causing the footpad (127) to rotate the main drive cylinder (119) in a direction toward the base (7). This motion is vertically downward and horizontally away from the center point of the user. The motion is also to the left of the user. The motion of the first footpad (127) will in turn cause lever (145) to rotate in the same direction about the drive axis (219). As the lever (145) rotates toward the base (7), the belt (149) connected to the lever (145) is also caused to advance in a direction that will cause the first one-way clutch (103) to be rotated in a direction whereby the one-way clutch engages the drive shaft (91) and causes the drive shaft (91) to be rotated against the resistance provided by the resistance mechanism (905). The advancement of the belt (149) also generally causes the spring member (155) connected to the belt (149) to be elongated.

After the first footpad (127) has been caused to move in a direction toward the base (7), the user then shifts a substantial portion of his body weight on the other foot pad (127) to cause that footpad (127) (which is for the right foot in this example) to advance toward the base (7). Again the motion of the footpad (127) is horizontally away from the center and vertically downward. This motion is now to the right. As the other footpad (127) is advanced in a direction toward the base (7), the lever (145) connected to this footpad (127) through the main drive cylinder (119) will cause the belt (149) to advance over the second one-way clutch (107) and causes the drive shaft (91) to rotate. Again the rotation of the drive shaft (91) is effected by the resistance mechanism (905) to produce the exercise.

As the second foot pad (127) is advanced toward the base (7), the first foot pad (127) is rotated away from the base (7) and back toward its starting position by the force of the spring member (155) acting through the belt (149) on the lever (145) connected to the main drive cylinder (119) on which the footpad (127) is connected. As the first footpad (127) is advancing away from the base (7), the direction of travel of the belt (149) over the first one-way clutch (103) is such that the clutch is not engaged and the clutch free wheels around the drive shaft (91). In this manner, the drive shaft (91) is alternatively driven by the footpads (127) as they are advanced toward the base (7) and away from the other footpad (127). However, the return motion of the footpad (127) away from the base (7) does not engage the one-way clutches (103) and (107) and does not cause the drive shaft (91) to rotate. Therefore the return motion requires much less work. The footpads (127) can be advanced toward the base (7) until the footpads (127) reach a predetermined lower point, or until the user shifts their weight.

The motion that the user uses to drive the machine is a sideways motion. That is, to impart motion to the foot pad (127) the user causes his foot to move in a sideways direction (again perpendicular to a line from the heel to the toe when the foot is placed in a standard forward facing position). As the foot pad (127) is caused to advance toward the base (7) the right foot will move to the right and the left foot will move to the left. The motion experienced by the user's feet on the foot pads (127) is substantially perpendicular to the motion experienced by a person's feet when walking or running providing for a much different workout from traditional systems.

Figure 1:
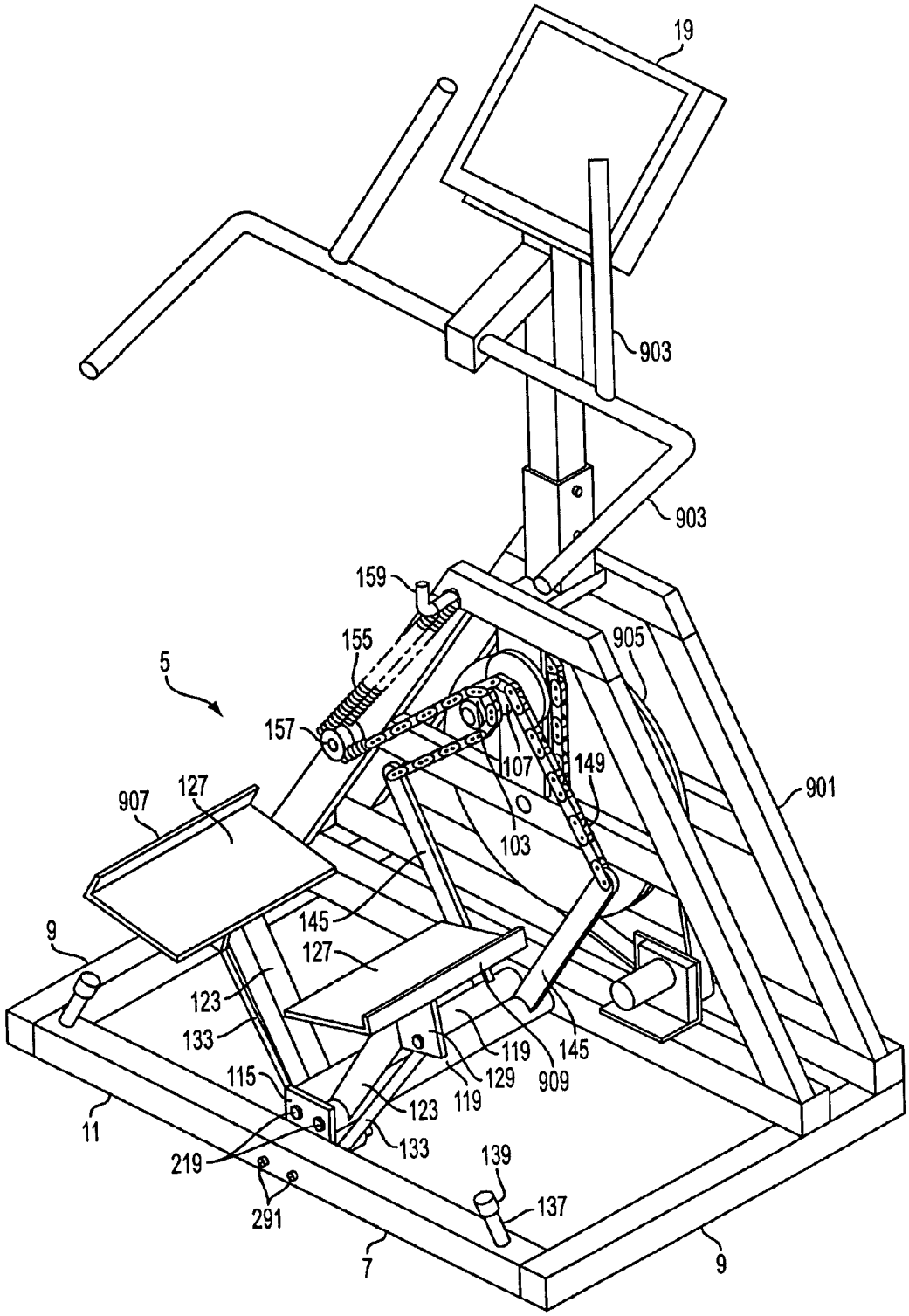
FIG. 1 is a perspective view of an embodiment of a side-to-side exercise machine utilizing a mechanical resistance.
Figure 2:
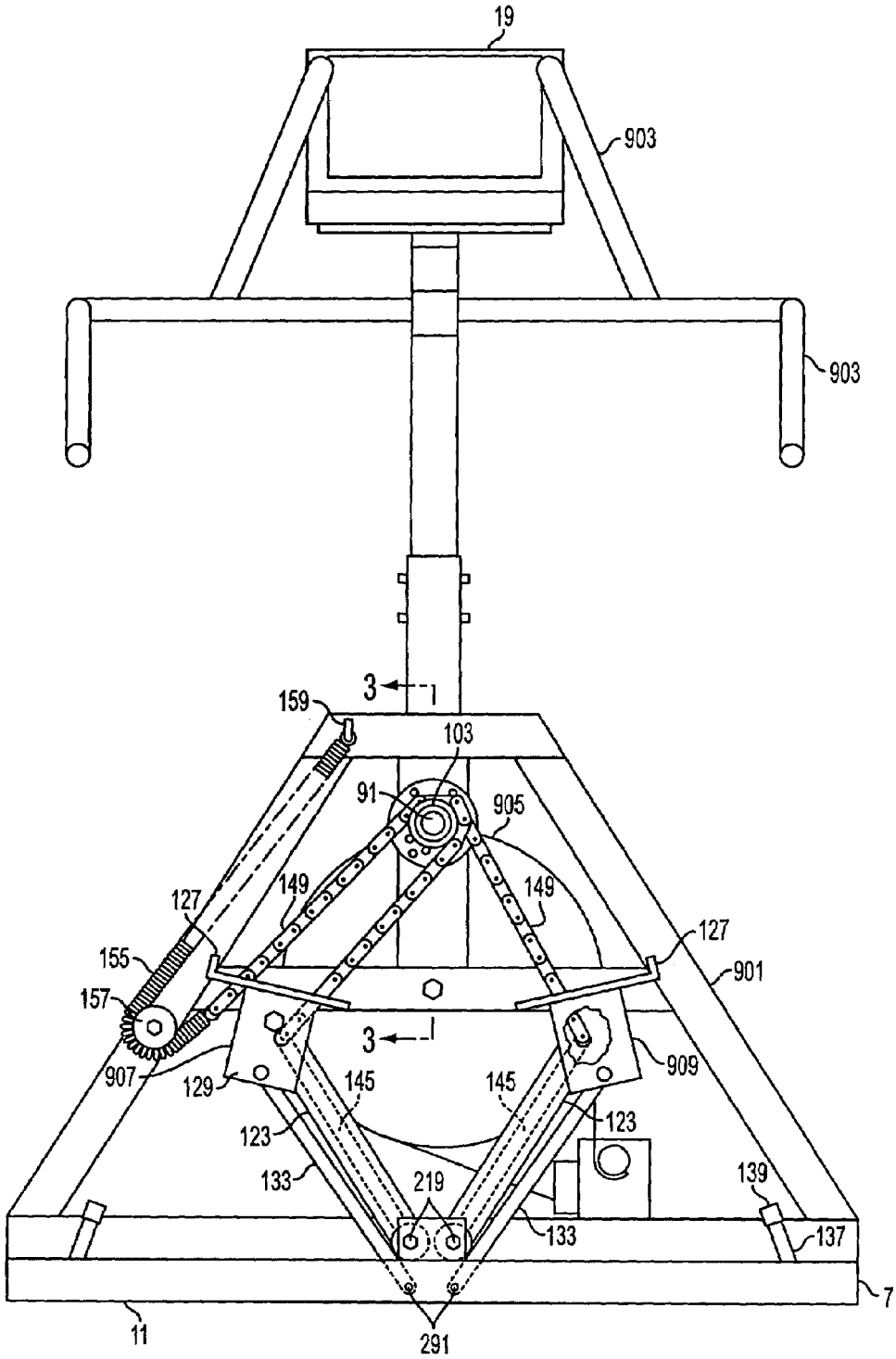
FIG. 2 is a front elevational view of the embodiment of FIG. 1.
Figure 3:
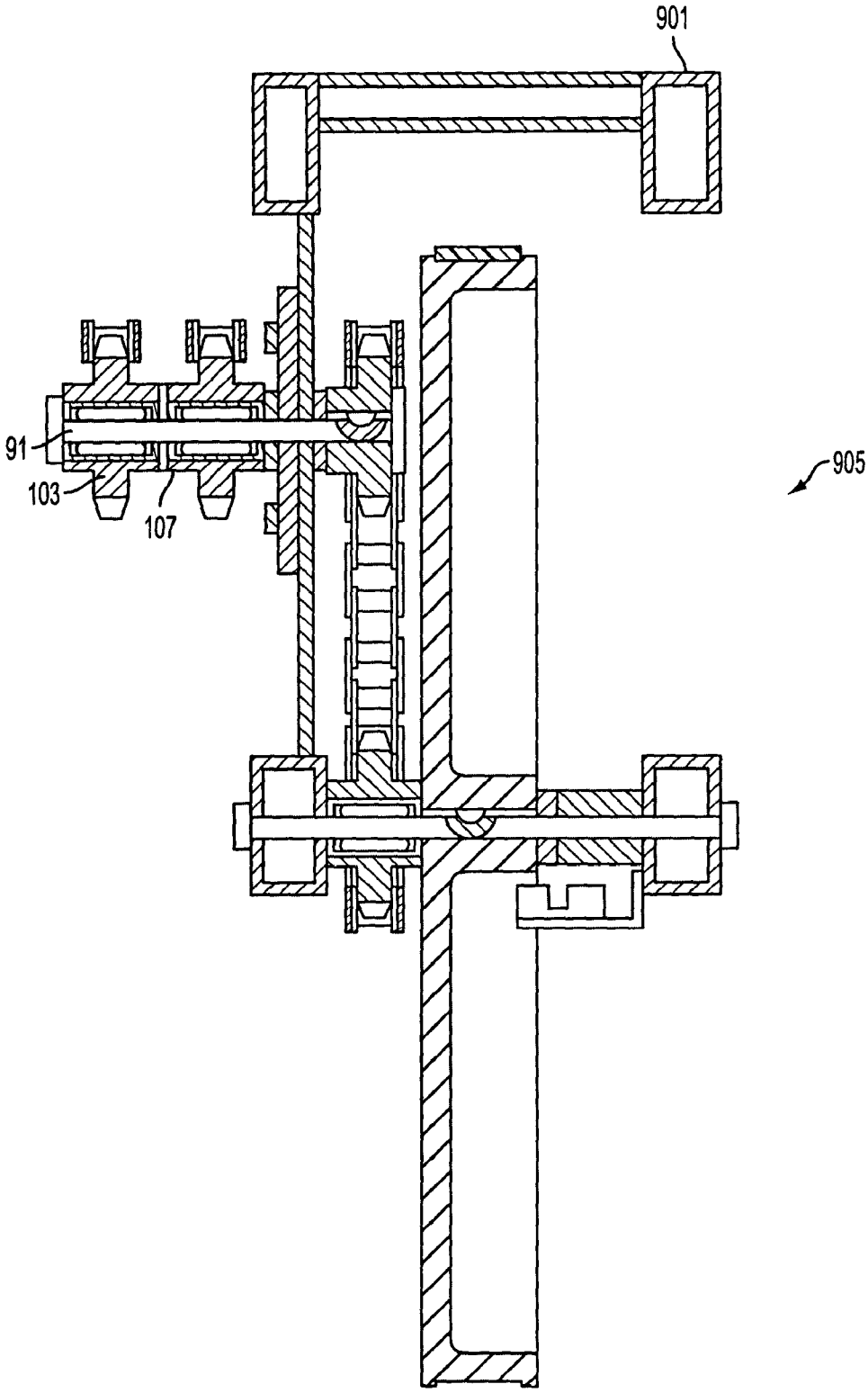
FIG. 3 is a partial cross-sectional view taken along fine 3-3 in FIG. 2.
Figure 4:
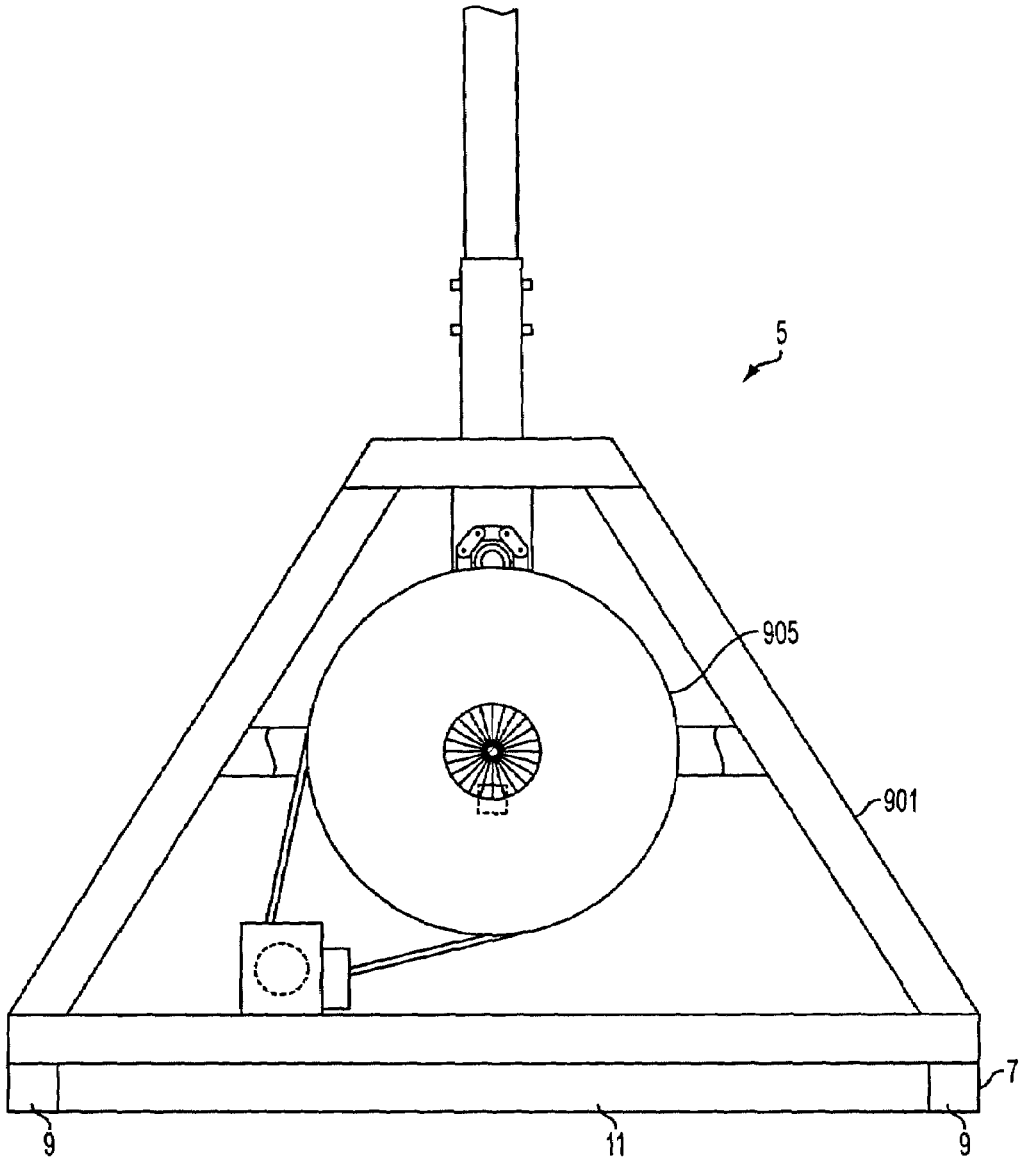
FIG. 4 is a partial back view of the embodiment of FIG. 1
Figure 6:
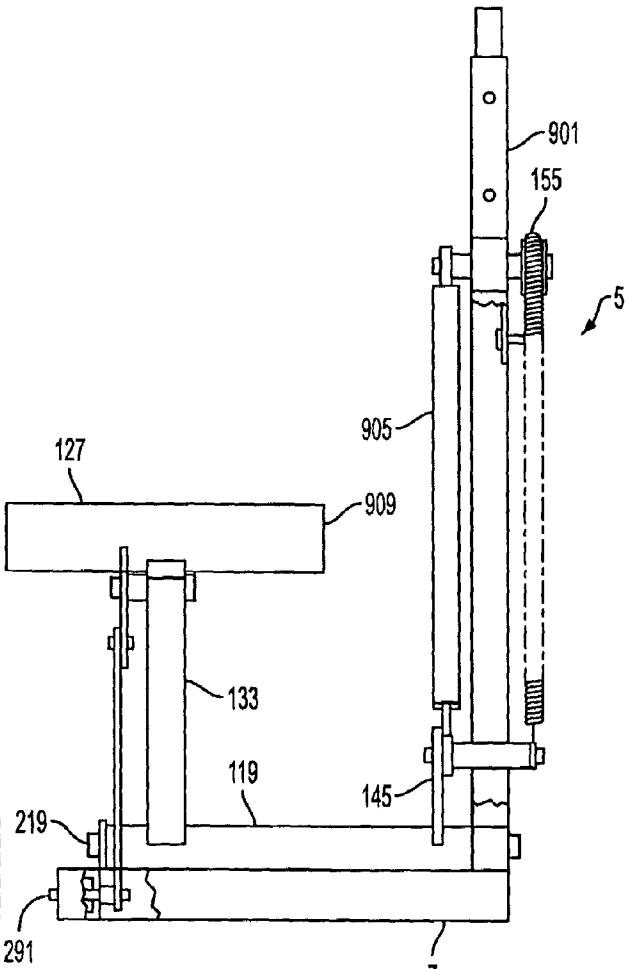
FIG. 6 is a partial side-elevational view of the embodiment of FIG. 5.
Figure 5:
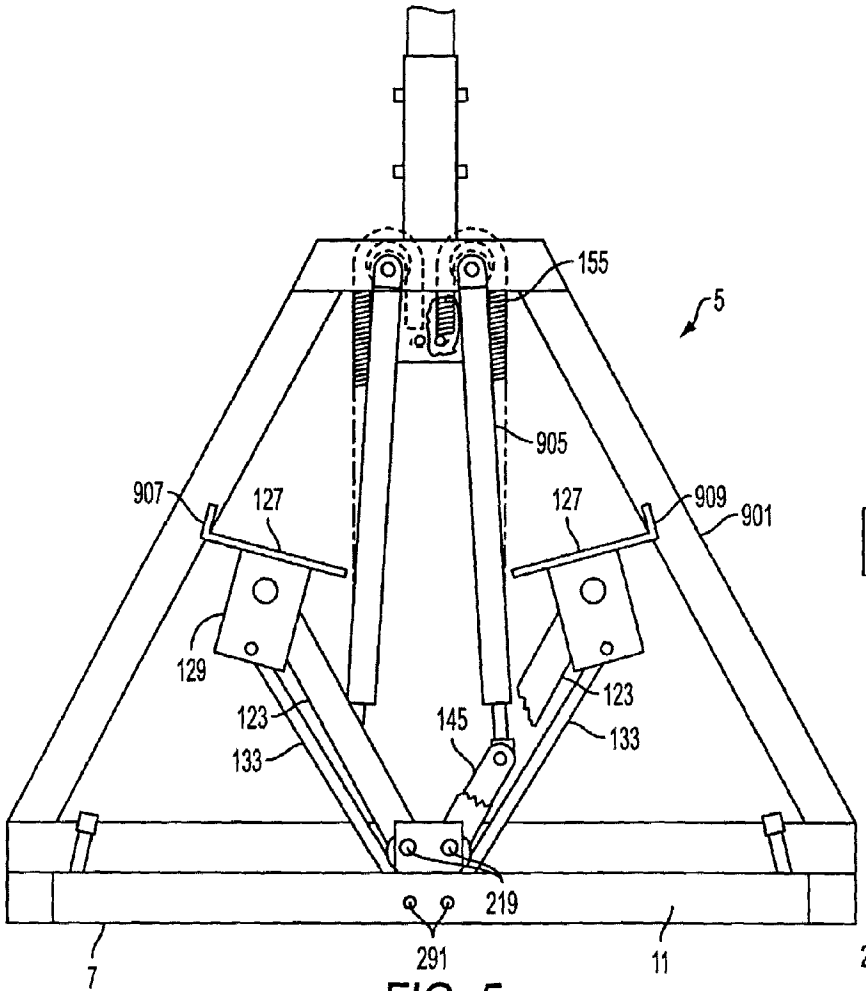
FIG. 5 is a partial front-elevational view of second embodiment of a side-to-side exercise machine which utilizes a pressure cylinder for resistance.
Figure 7:
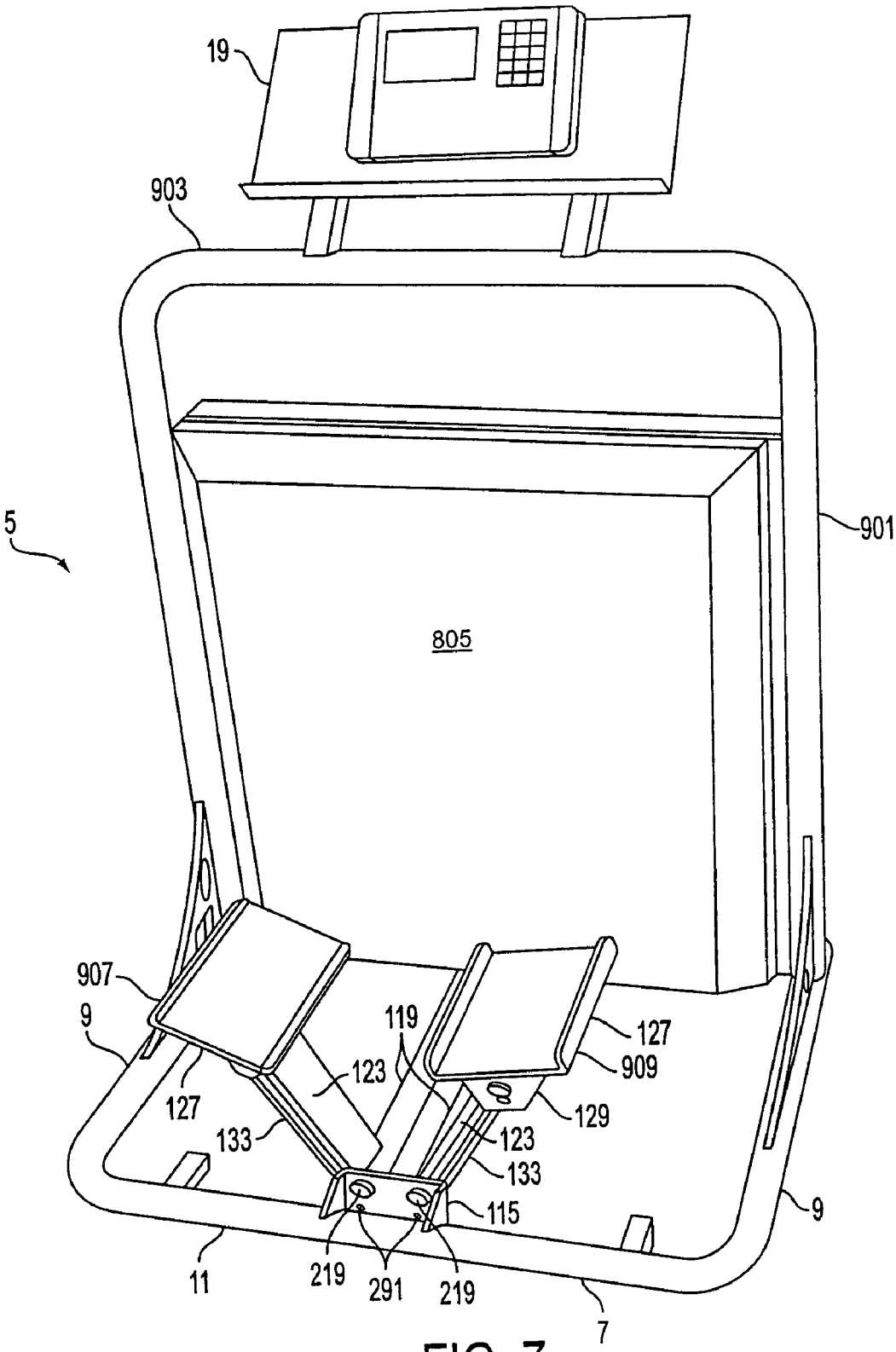
FIG. 7 is a perspective view of a third embodiment of a side-to-side exercise machine which utilizes electromechanical resistance.
Figure 8:
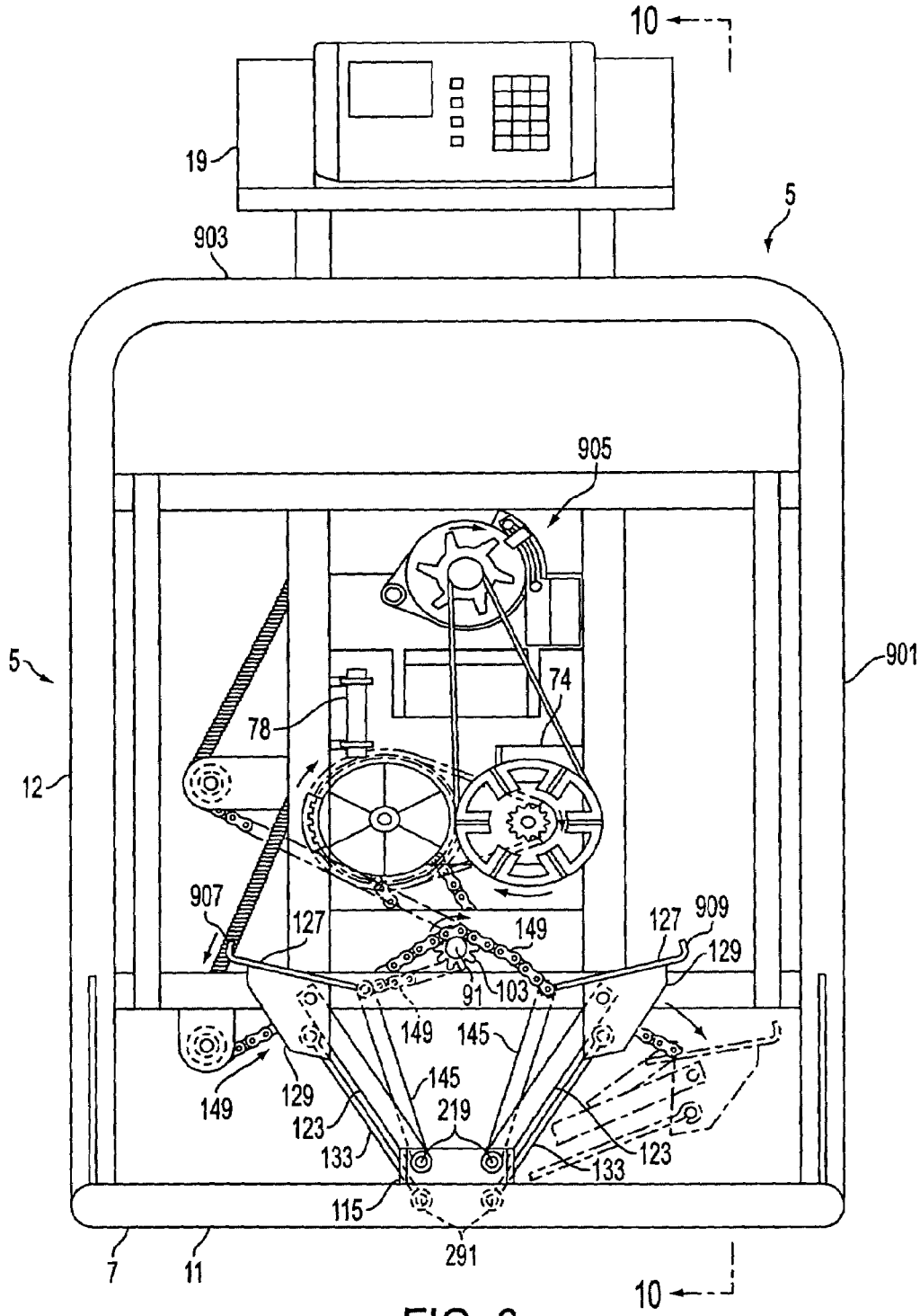
FIG. 8 is a front elevational view of the embodiment of FIG. 7 showing movement of a footpad assembly in phantom.
Figure 9:
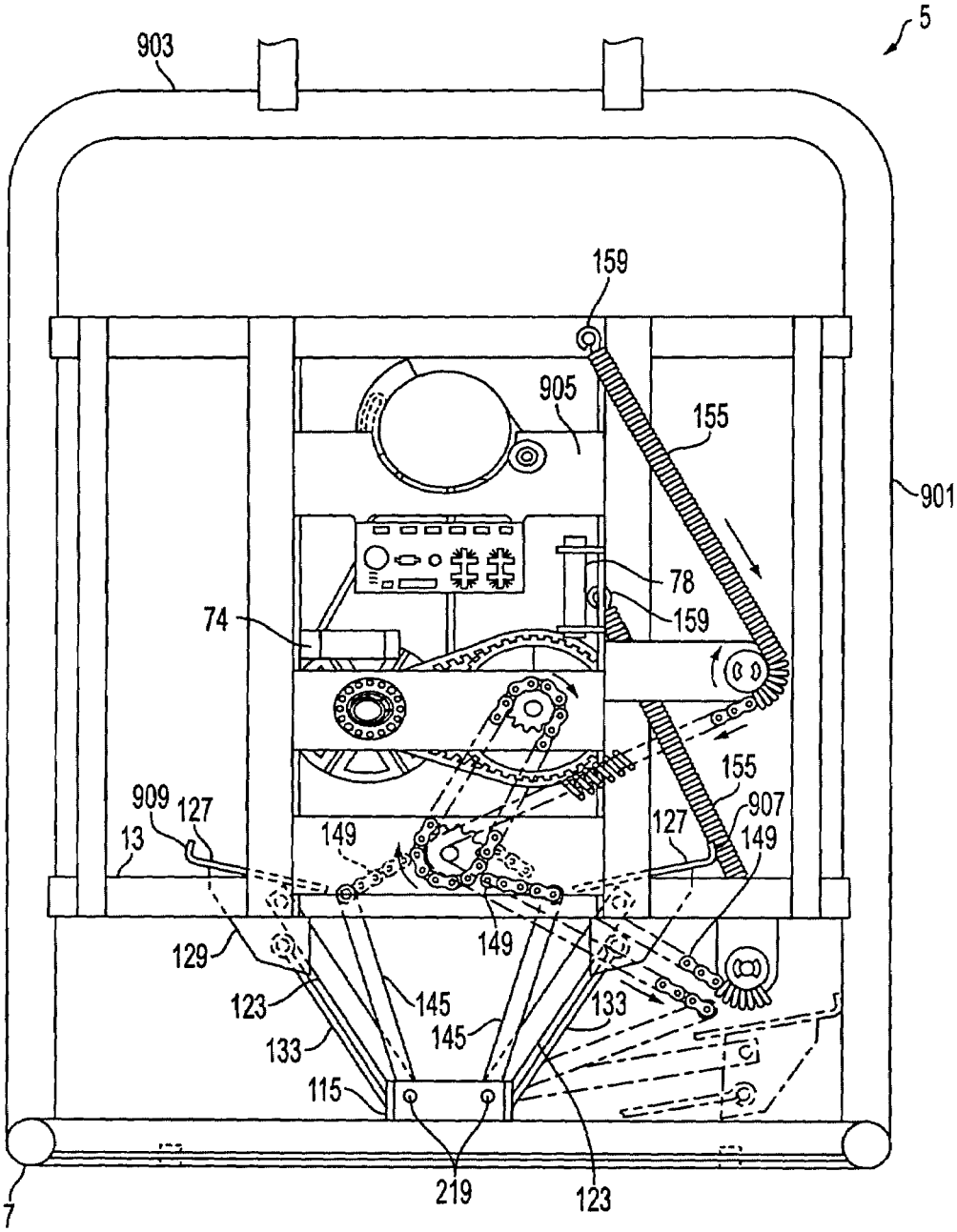
FIG. 9 is a partial back view of the embodiment of FIG. 7 also showing movement of a footpad assembly in phantom.
Figure 10:
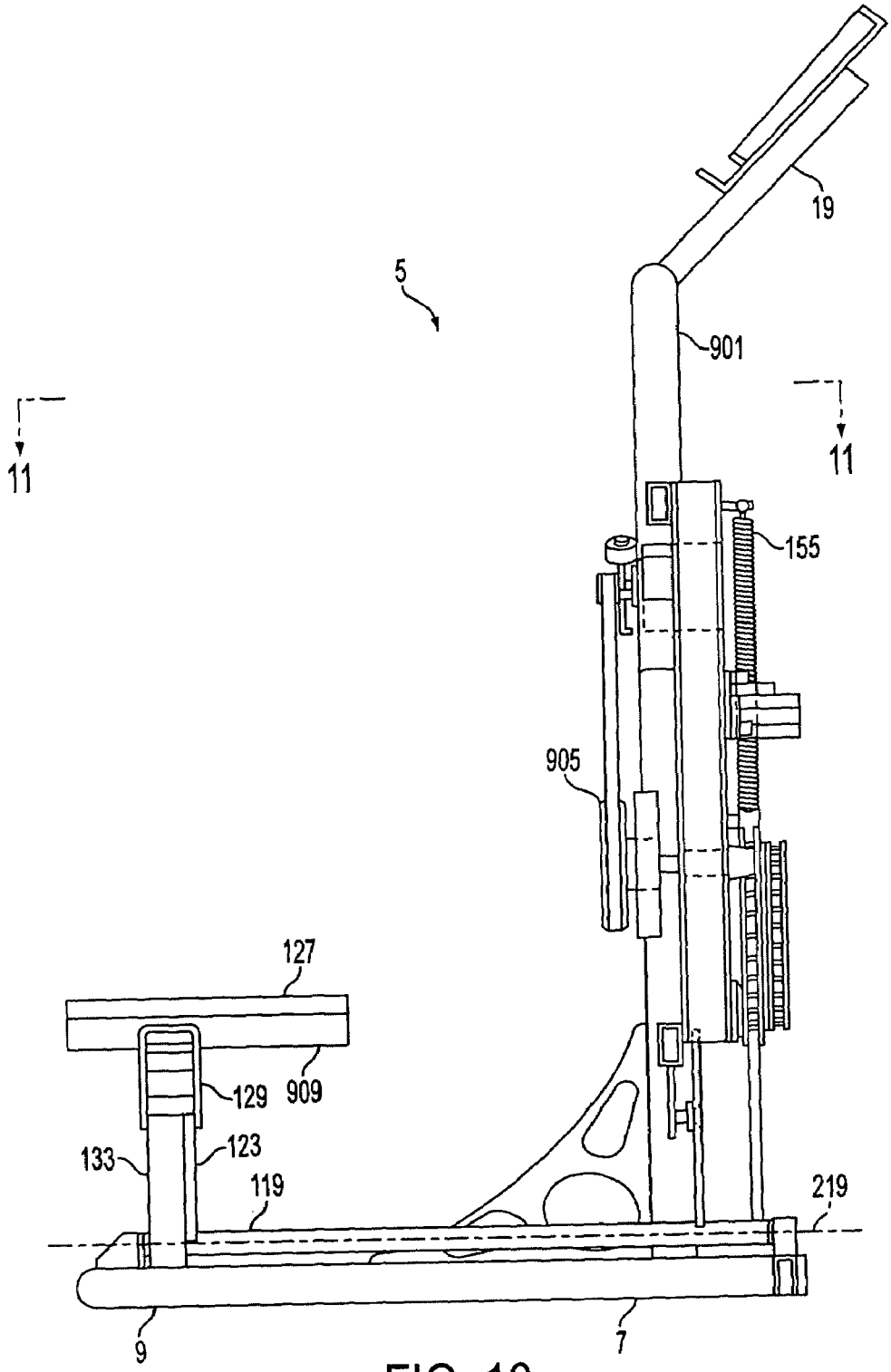
FIG. 10 is a side elevational view of the embodiment of FIG. 7
Figure 11:
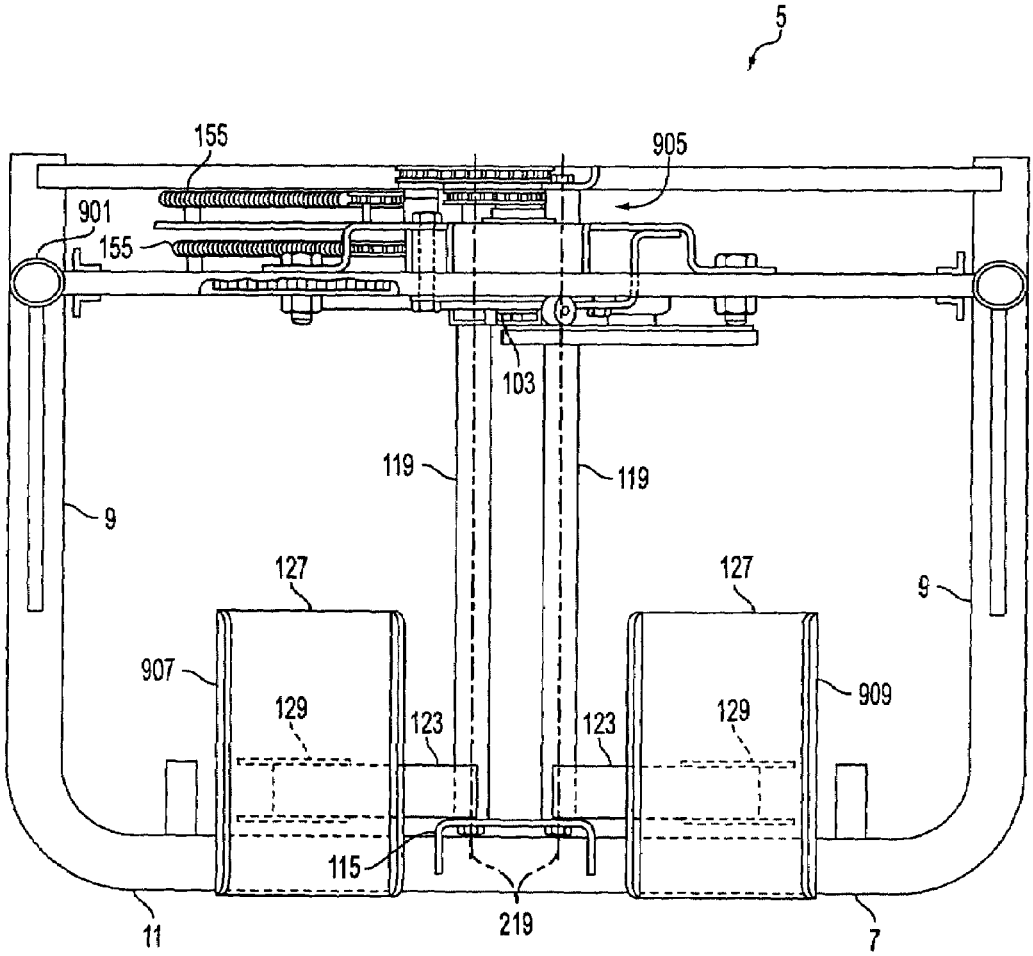
FIG. 11 is a partial cross-sectional view taken along line 11-11 in FIG. 9.
Figure 12:
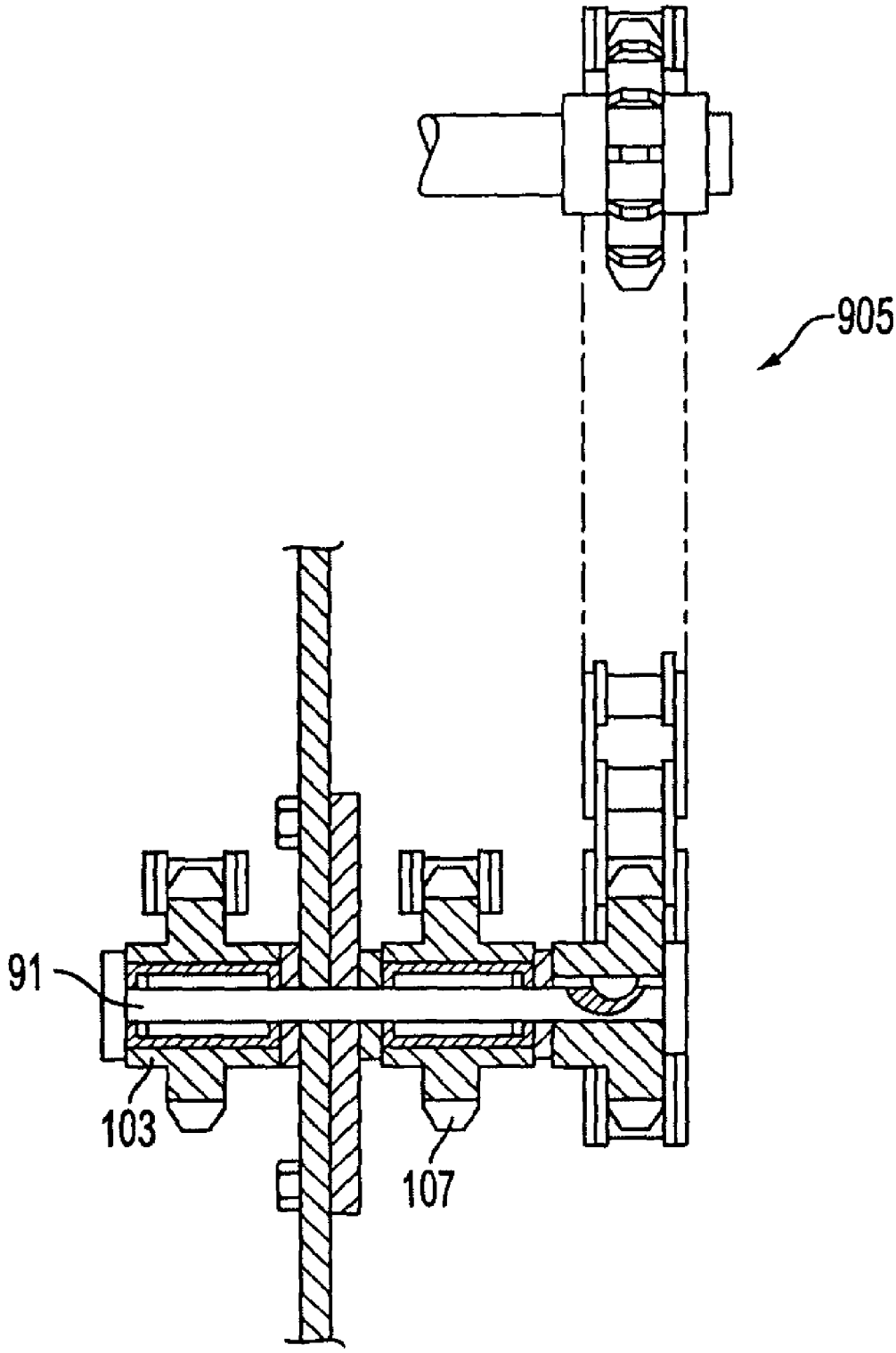
FIG. 12 is a partial cross-sectional view of a portion of the embodiment of FIG. 7.
Figure 13:
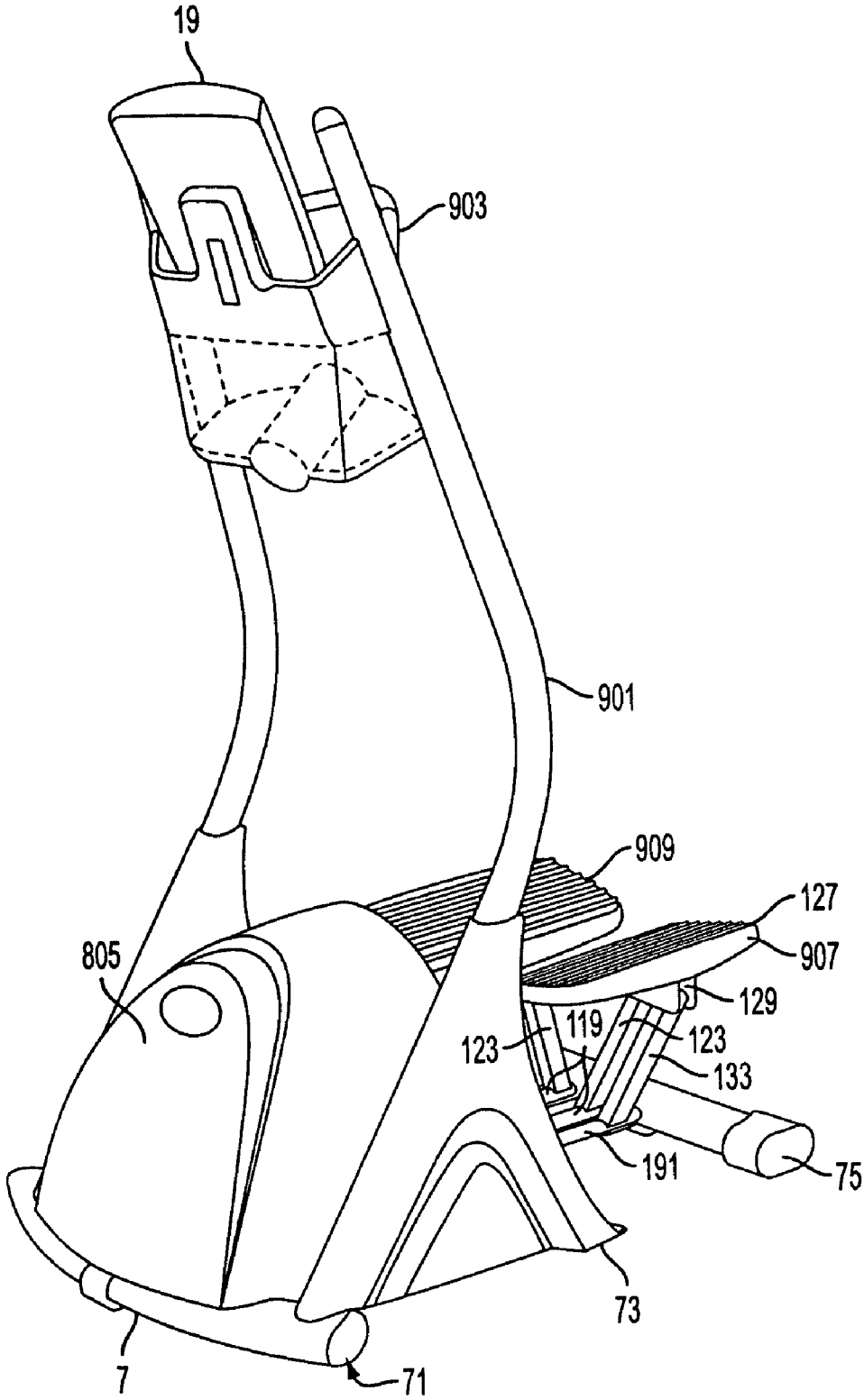
FIG. 13 is a perspective view of a fourth embodiment of a side to side exercise machine which utilizes electromechanical resistance.
Figure 14:
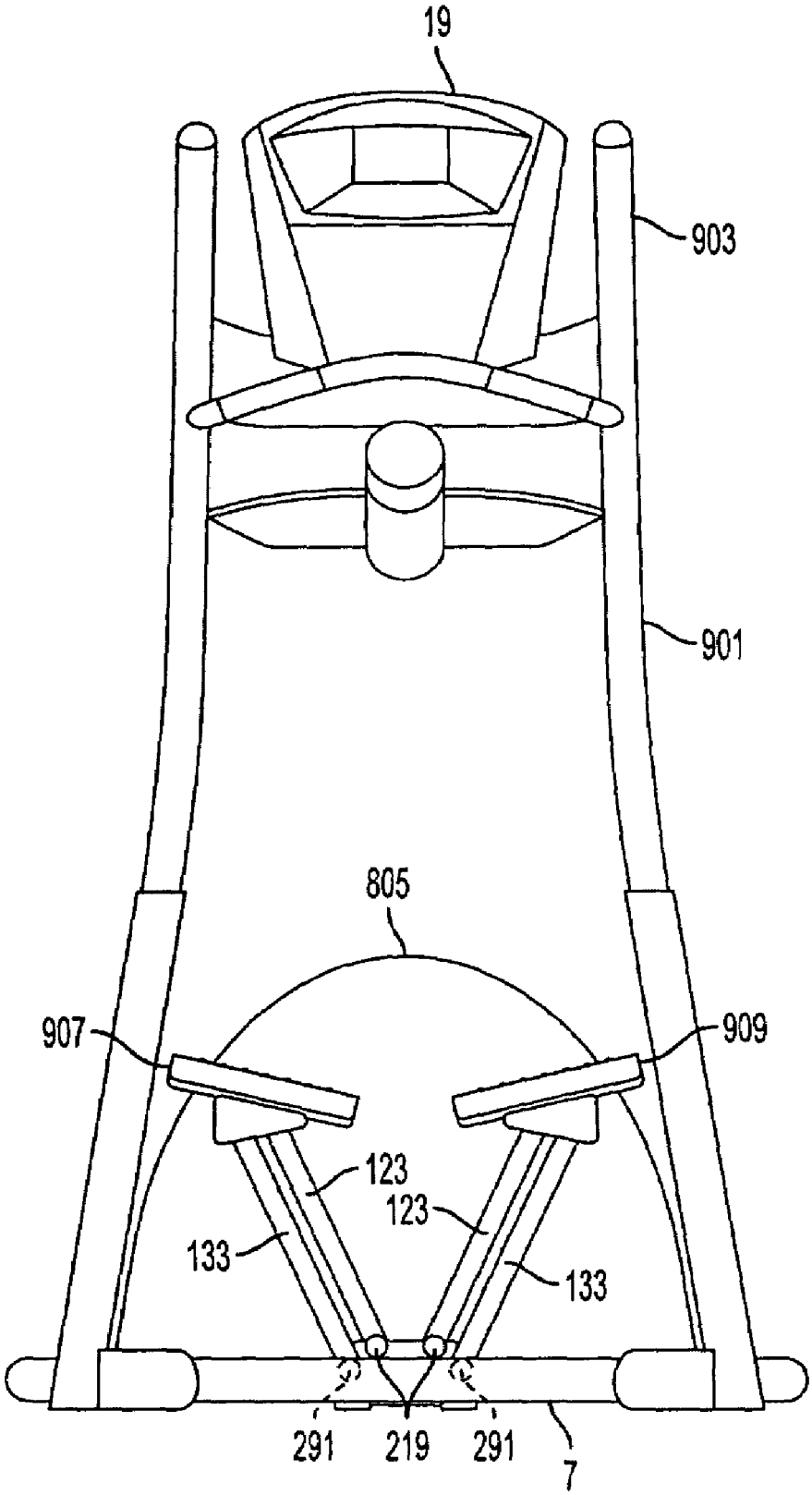
FIG. 14 is a front elevational view of the embodiment of FIG. 13.
Figure 15:
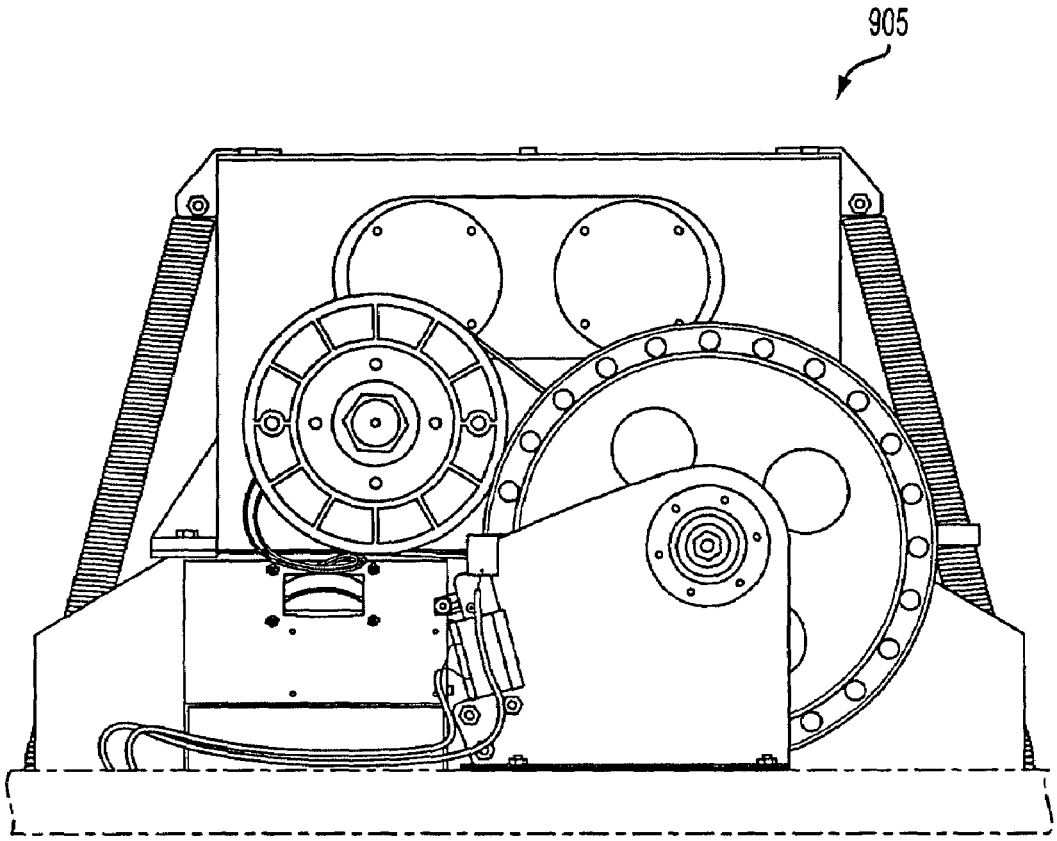
FIG. 15 is a rear view of a part of the resistance mechanism of the embodiment of FIG. 13 with the protective cover removed.
Figure 16:
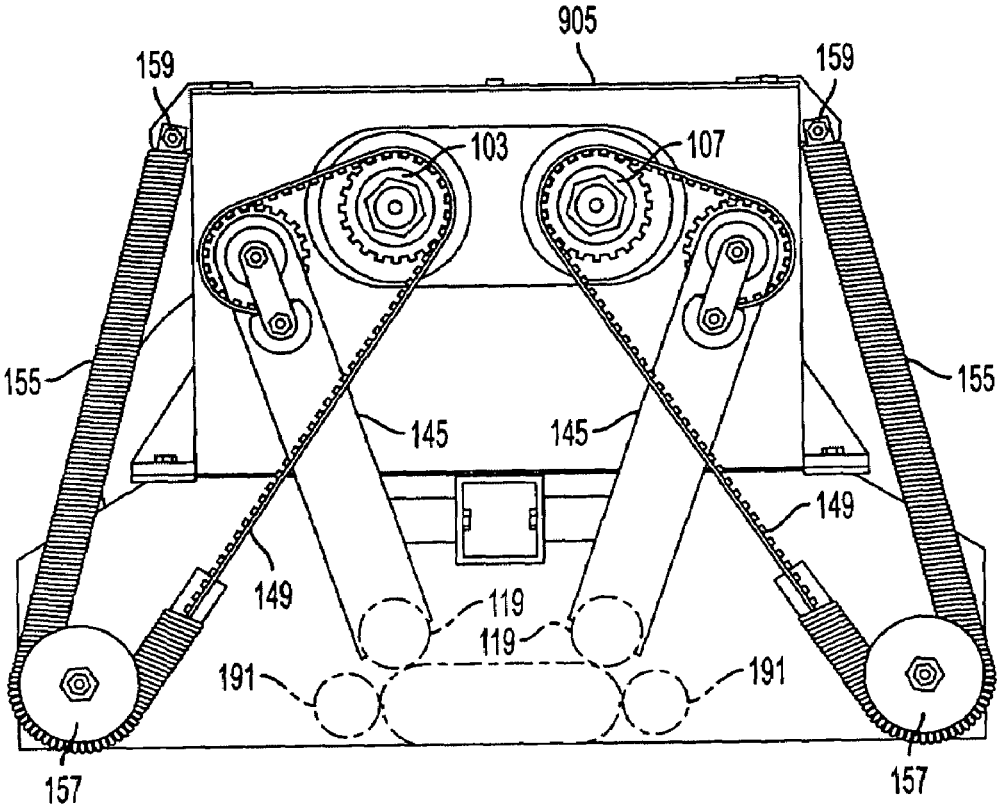
FIG. 16 is a front view of the resistance mechanism and transfer structure of the embodiment of FIG. 13 with the protective cover removed.

The motion of the embodiments is generally similar with regards to the embodiment of FIGS. 5-6. However, the transfer system (911) is eliminated as the footpad (127) motion may be directly imparted to the pressure cylinders to provide for the resistance.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. An exercise machine comprising:

a frame;

a first footpad connected to said frame so as to rotate along a first path in a first direction about a first drive axis;

a second footpad connected to said frame so as to rotate along a second path in a second direction about a second drive axis;

a resistance mechanism attached to said frame, said resistance mechanism effecting said rotation of said first footpad along said first path and said rotation of said second footpad along said second path; and a first footpad assembly fixing said first footpad at all points along said first path and a second footpad assembly fixing said second footpad at all points along said second path such that said first footpad and said second footpad are in a generally parallel orientation relative to each other at all said points;

wherein said second path is non-parallel to said first path;

wherein said first drive axis is fixed in a generally parallel orientation relative to said second drive axis; and wherein said first footpad and said second footpad each move independently of the motion of the other.

2. The machine of claim 1 wherein said resistance mechanism resists said rotation of said first footpad along said first path and said rotation of said second footpad along said second path.

3. The machine of claim 1 wherein said resistance mechanism will brake a drive shaft being alternatively driven by said first footpad rotating along said first path and then said second footpad rotating along said second path when said drive shaft reaches a predetermined velocity.

4. The machine of claim 1 wherein said first drive axis and said second drive axis are arranged substantially horizontally.

5. The machine of claim 1 wherein said first drive axis is not co-linear with said second drive axis.

6. The machine of claim 1 wherein said first path is a mirror image of said second path.

7. The machine of claim 6 wherein said first path, when viewed from a fixed location, comprises rotation in a clockwise direction about said first drive axis and said second path when viewed from said fixed location, comprises rotation in a counterclockwise direction about said second drive axis.

8. The machine of claim 6 wherein said first path and said second path include motion which is vertically downward.

9. The machine of claim 1 wherein said flame includes a base and a vertical support.

10. The machine of claim 9 wherein said vertical support includes handgrips.

11. The machine of claim 1 wherein a control panel is attached to said frame.

12. The machine of claim 1 further including a mechanism for collecting physiological data of a user of the machine.

13. The machine of claim 10 wherein said physiological data is used to alter the operation of said machine.

14. The machine of claim 1 wherein said first path is coplanar with said second path.

15. The machine of claim 1 wherein each of said first foot pad and said second foot pad are rotationally mounted to an arm and each of said arms rotates about the appropriate drive axis.

16. The machine of claim 15 wherein said arm extends as said first foot pad traverses said first path.

17. The machine of claim 15 wherein each of said first footpad and said second footpad are rotationally mounted to a link and each of said links rotates about a link axis.

18. The machine of claim 17 wherein said link and said arm work together to maintain the angle of said footpads relative to the horizontal.

19. The machine of claim 1 wherein said first footpad retains a constant angle to the horizontal while rotating along said first path.

20. The machine of claim 1 wherein said resistance mechanism utilizes electromagnetic resistance.

21. The machine of claim 20 wherein said resistance mechanism comprises an eddy current brake (ECB).

22. The machine of claim 20 wherein said resistance mechanism includes a brake on a drive shaft.

23. The machine of claim 1 wherein the user adjusts the speed of their motion to alter the difficulty of the exercise.

24. An exercise machine comprising:

a frame;

means attached to said flame for having a first foot of a user move along a first path;

means attached to said flame for having a second foot of a user move along a second path, wherein said second path is non-parallel to said first path and said second path and said first path are coplanar;

means attached to said frame for effecting said movement of said first foot along said first path and for effecting said movement of said second foot along said second path; and means for fixing said first footpad at all points along said first path and said second footpad at all points along said second path in a generally parallel orientation;

wherein said movement of said first foot occurs independently of said movement of said second foot.

25. A method of exercising comprising:

providing an exercise machine including:

a frame; and at least two footpads moveably mounted on said frame such that each of said footpads can move independently of the other;

placing a first human foot on a first of said footpads;

placing a second human foot on a second of said footpads;

visualizing a first plane passing through the toe, heel, and calf of said first human foot and a second plane passing through the toe, heel, and calf of said second human foot;

moving said first human foot and said second human foot interchangeably in a manner so as that said planes are both translated relatively simultaneously along a path non-parallel to said planes, and so as that said first human foot and said second human foot remain generally parallel throughout the movement.

26. The method of claim 25 wherein said translation is along an arcuate path.

27. The method of claim 25 wherein said translation is along a linear path.

28. The method of claim 25 wherein said translation is along a path having a component perpendicular to at least one of said planes.

29. The method of claim 25 wherein the translation of said first plane is coplanar with the translation of said second plane.

* * * * *